US009162453B2

(12) United States Patent
Cruz-Uribe et al.

(10) Patent No.: US 9,162,453 B2
(45) Date of Patent: Oct. 20, 2015

(54) PRINTHEAD INCLUDING INTEGRATED CIRCUIT DIE COOLING

(75) Inventors: Tony S. Cruz-Uribe, Corvallis, OR (US); James Edward Clark, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/397,569

(22) PCT Filed: Jul. 30, 2012

(86) PCT No.: PCT/US2012/048783

§ 371 (c)(1), (2), (4) Date: Oct. 28, 2014

(87) PCT Pub. No.: WO2014/021812

PCT Pub. Date: Feb. 6, 2014

(65) Prior Publication Data

US 2015/0124019 A1 May 7, 2015

(51) Int. Cl.

| | |
|---|---|
| ***B41J 29/377*** | (2006.01) |
| ***B41J 2/14*** | (2006.01) |
| ***B41J 2/175*** | (2006.01) |
| ***B41J 29/393*** | (2006.01) |

(52) U.S. Cl.

CPC ..... *B41J 2/14* (2013.01); *B41J 2/14233* (2013.01); *B41J 2/175* (2013.01); *B41J 29/377* (2013.01); *B41J 29/393* (2013.01); *B41J 2002/14241* (2013.01); *B41J 2202/08* (2013.01); *B41J 2202/12* (2013.01)

(58) Field of Classification Search

CPC ..... B41J 29/377; B41J 2/18; B41J 2202/08
USPC ..... 347/17, 18, 20, 54, 68, 70–72, 84, 85, 347/89

See application file for complete search history.

(56) References Cited

U.S. PATENT DOCUMENTS 5,992,963 A 11/1999 Miyake et al.
6,254,214 B1 * 7/2001 Murthy et al. ..... 347/17

* cited by examiner

*Primary Examiner* — An Do
(74) *Attorney, Agent, or Firm* — Dicke, Billig & Czaja, PLLC (PAT)

(57) ABSTRACT

One example provides a printhead including a substrate and a fluidics structure attached to the substrate. The fluidics structure includes actuators for ejecting ink from the printhead. The printhead includes an integrated circuit die attached to the substrate. The integrated circuit die is for driving the actuators. The integrated circuit die is cooled by a coolant contacting the integrated circuit die and flowing through the substrate.

15 Claims, 12 Drawing Sheets

PRINTHEAD INCLUDING INTEGRATED CIRCUIT DIE COOLING

CROSS-REFERENCE TO RELATED APPLICATIONS

This Utility Patent Application is a U.S. National Stage filing under 35 U.S.C. §371 of PCT/US12/048783, filed Jul. 30, 2012, incorporated by reference herein.

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

One type of printhead includes a piezoelectric printhead. The piezoelectric printhead includes a substrate defining a fluid chamber, a flexible membrane supported by the substrate over the fluid chamber, and an actuator provided on the flexible membrane. In one arrangement, the actuator includes a piezoelectric material which deforms when an electrical voltage supplied by a drive circuit is applied to the actuator. As such, when the piezoelectric material deforms, the flexible membrane deflects thereby causing ejection of fluid from the fluid chamber and through an orifice in fluid communication with the fluid chamber. Both the actuator and the drive circuit generate excess heat during operation. The excess heat should be removed from the system to maintain consistent operation of the actuator and the drive circuit.

DETAILED DESCRIPTION

In the following detailed description, reference is made to the accompanying drawings which form a part hereof, and in which is shown by way of illustration specific examples in which the disclosure may be practiced. In this regard, directional terminology, such as "top," "bottom," "front," "back," "leading," "trailing," etc., is used with reference to the orientation of the Figure(s) being described. Because components of examples can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined with each other, unless specifically noted otherwise.

Figure 1:
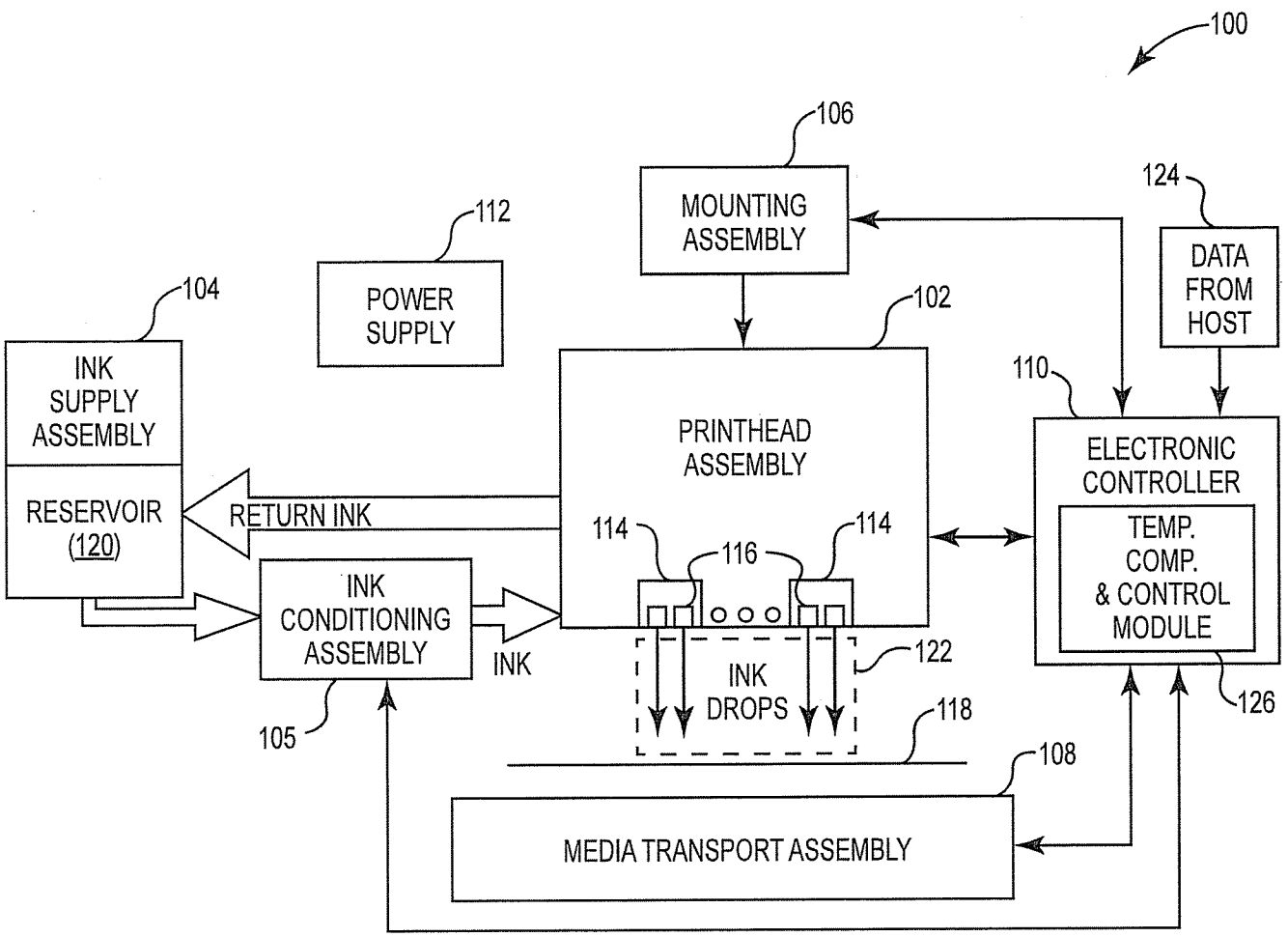
FIG. 1 is a block diagram illustrating one example of an inkjet printing system.

FIG. 1 is a block diagram illustrating one example of an inkjet printing system 100. Inkjet printing system 100 includes a piezoelectric inkjet (PIJ) printhead having pulse forming circuits and piezoelectric actuators formed on a common substrate. Heat is generated in the PIJ printhead due to the pulse forming circuits (i.e., drive integrated circuits (ICs)) and the piezoelectric actuators. Examples of the disclosure include ink and/or coolant flow paths in the common substrate that enable efficient heat removal from the pulse forming circuits and the piezoelectric actuators. In one example, ink is used as a coolant for cooling the drive ICs and the piezoelectric actuators. In another example, a non-ink fluid is used as a coolant for cooling the drive ICs.

Inkjet printing system 100 includes an inkjet printhead assembly 102, an ink supply assembly 104, an ink conditioning assembly 105, a mounting assembly 106, a media transport assembly 108, an electronic printer controller 110, and at least one power supply 112 that provides power to the various electrical components of inkjet printing system 100. Inkjet printhead assembly 102 includes at least one fluid ejection assembly 114 (i.e., printhead 114) that ejects drops of ink through a plurality of orifices or nozzles 116 toward a print medium 118 so as to print onto print medium 118. Print medium 118 can be any type of suitable sheet or roll material, such as paper, card stock, transparencies, polyester, plywood, foam board, fabric, canvas, and the like. Nozzles 116 are typically arranged in one or more columns or arrays such that properly sequenced ejection of ink from nozzles 116 causes characters, symbols, and/or other graphics or images to be printed on print medium 118 as inkjet printhead assembly 102 and print medium 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one example, ink supply assembly 104 supplies ink under positive pressure through an ink conditioning assembly 105 to inkjet printhead assembly 102 via an interface connection, such as a supply tube. Ink supply assembly 104 includes, for example, a reservoir 120, pumps and pressure regulators. Conditioning in the ink conditioning assembly 105 may include filtering, pre-heating, pressure surge absorption, and degassing. Ink is drawn under negative pressure from the printhead assembly 102 to the ink supply assembly 104. The pressure difference between the inlet and outlet to the printhead assembly 102 is selected to achieve the correct backpressure at the nozzles 116, and is usually a negative pressure between negative 1" and negative 10" of $H_2O$. Reservoir 120 of ink supply assembly 104 may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one example, inkjet printhead assembly 102 is a scanning type printhead assembly. As such, mounting assembly 106 includes a carriage for moving inkjet printhead assembly 102 relative to media transport assembly 108 to scan print media 118. In another example, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

Electronic printer controller 110 typically includes a processor, firmware, software, one or more memory components including volatile and non-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic printer controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters from data 124. In one example, electronic controller 110 includes temperature compensation and control module 126 stored in a memory of controller 110. Temperature compensation and control module 126 executes on electronic controller 110 (i.e., a processor of controller 110) and specifies the temperature that circuitry in the die stack (e.g., an ASIC) maintains for printing. Temperature in the die stack is controlled locally by on-die circuitry that includes temperature sensing resistors and heater elements in the pressure chambers of fluid ejection assemblies (i.e., printheads) 114. More specifically, controller 110 executes instructions from module 126 to sense and maintain ink temperatures within pressure chambers through control of temperature sensing resistors and heater elements on a circuit die adjacent to the chambers.

In one example, inkjet printing system 100 is a drop-on-demand piezoelectric inkjet printing system with a fluid ejection printhead assembly 102 comprising a piezoelectric inkjet (PIJ) printhead 114. The PIJ printhead 114 includes a multilayer microelectromechanical system (MEMS) die stack and one or more die containing control and drive circuitry. The die stack includes a thin film piezoelectric actuator ejection element configured to generate pressure pulses within a pressure chamber that force ink drops out of a nozzle 116. In one implementation, inkjet printhead assembly 102 includes a single PIJ printhead 114. In another implementation, inkjet printhead assembly 102 includes a wide array of PIJ printheads 114.

Figure 2:
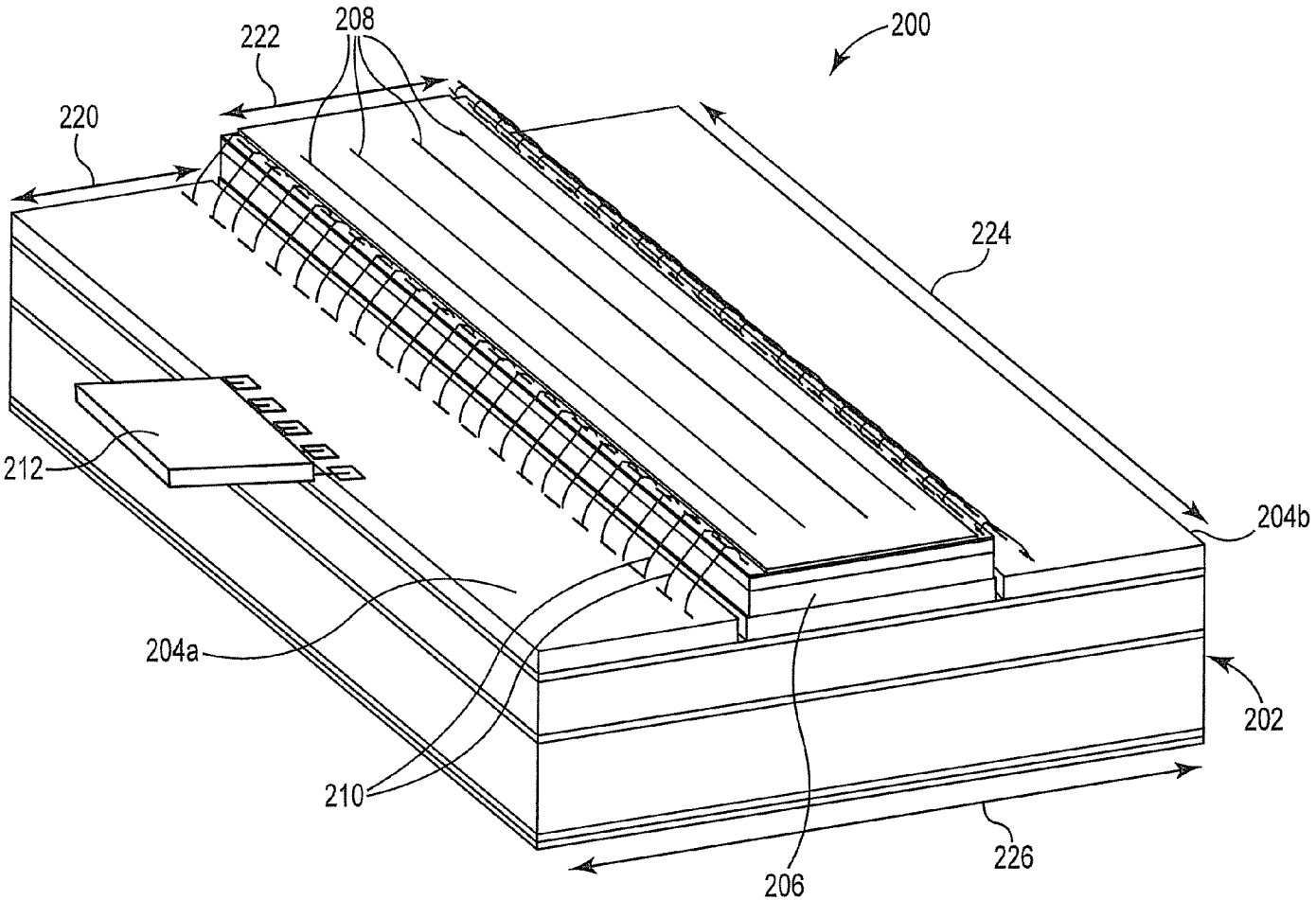
FIG. 2 is a diagram illustrating one example of a piezoelectric inkjet (PIJ) printhead.

FIG. 2 is a diagram illustrating one example of a PIJ printhead 200. In one example, PIJ printhead 200 is used for printhead 114 previously described and illustrated with reference to FIG. 1. PIJ printhead 200 includes a substrate 202, drive integrated circuit (IC) dies 204*a* and 204*b*, a fluidics structure 206, and a flex connector 212. In one example, substrate 202 is a multilayer substrate including a plurality of stacked substrate dies, such as a polymer-stainless substrate die stack. Fluidics structure 206 also includes a plurality of stacked dies. Each layer of the die stack that provides printhead 200 includes fluid passageways, such as slots, channels, or holes for routing ink and/or coolant to and/or from the fluidics structure 206 and drive IC dies 204*a* and 204*b*. Fluidics structure 206 is stacked on and substantially centered on substrate 202. Fluidics structure 206 includes a plurality of piezoelectric actuators (not shown) and a plurality of corresponding nozzles 208. In one example, fluidics structure 206 includes 1056 nozzles in four columns of 264. In other examples, fluidics structure 206 includes another suitable number of nozzles arranged in another suitable number of columns.

In one example, PIJ printhead 200 uses a single color of ink, which is ejected through all four rows of nozzles 208. In another example, PIJ printhead 200 uses two colors of ink, one of which is ejected through two adjacent rows of nozzles 208 on a first side of the printhead and the other of which is ejected through the other two adjacent rows of nozzles 208 on a second side of the PIJ printhead 200. For printheads that use two colors of ink, each color has their own ink delivery system and ink channels.

Drive IC die 204*a* is stacked on substrate 202 on a first side of fluidics structure 206, and drive IC die 204*b* is stacked on substrate 202 on a second side of fluidics structure 206 opposite the first side. Drive IC die 204*a* and drive IC die 204*b* are electrically coupled to fluidics structure 206 through bond wires 210 for controlling the piezoelectric actuators of fluidics structure 206. Flex connector 212 is electrically coupled to drive IC dies 204*a* and 204*b*. Flex connector 212 supplies power, data, and control signals to drive IC dies 204*a* and 204*b* for operating PIJ printhead 200.

In one example, substrate 202 has a width as indicated at 226 between 15 mm and 20 mm, such as 17 mm. Substrate 202, drive IC dies 204*a* and 204*b*, and fluidics structure 206 have a length as indicated at 224 between 20 mm and 30 mm, such as 26.5 mm. Drive IC dies 204*a* and 204*b* have a width as indicated at 220 between 4 mm and 6 mm, such as 5.5 mm. Fluidics structure 206 has a width as indicated at 222 between 4 mm and 8 mm, such as 6 mm. In other examples, substrate 202, drive IC dies 204*a* and 204*b*, and fluidics structure 206 have other suitable dimensions.

In one example, the circuit of drive IC die 204*a* and the circuit of drive IC die 204*b* generate individual waveforms for driving each piezoelectric actuator (i.e., hot switching) of fluidics structure 206. In another example, the waveform for driving the piezoelectric actuators is received by the circuits of drive IC dies 204*a* and 204*b* via flex connector 212 (i.e., cold switching). The circuits of drive IC dies 204*a* and 204*b* then control the switching of the received signal to each piezoelectric actuator of fluidics structure 206. Compared to cold switching, hot switching generates substantially more heat in drive IC dies 204*a* and 204*b*. In one example, up to 30 watts of heat is possible when all actuators are firing.

In one example, PIJ printhead 200 includes a metal cover (not shown) over drive IC dies 204*a* and 204*b*. The metal cover may be used as a heat sink for cooling drive IC dies 204*a* and 204*b*. In one example, the metal cover is spaced apart from the top of drive IC dies 204*a* and 204*b* and thermally coupled to the top of drive IC dies 204*a* and 204*b* by a heat transfer leaf spring.

Figure 3:
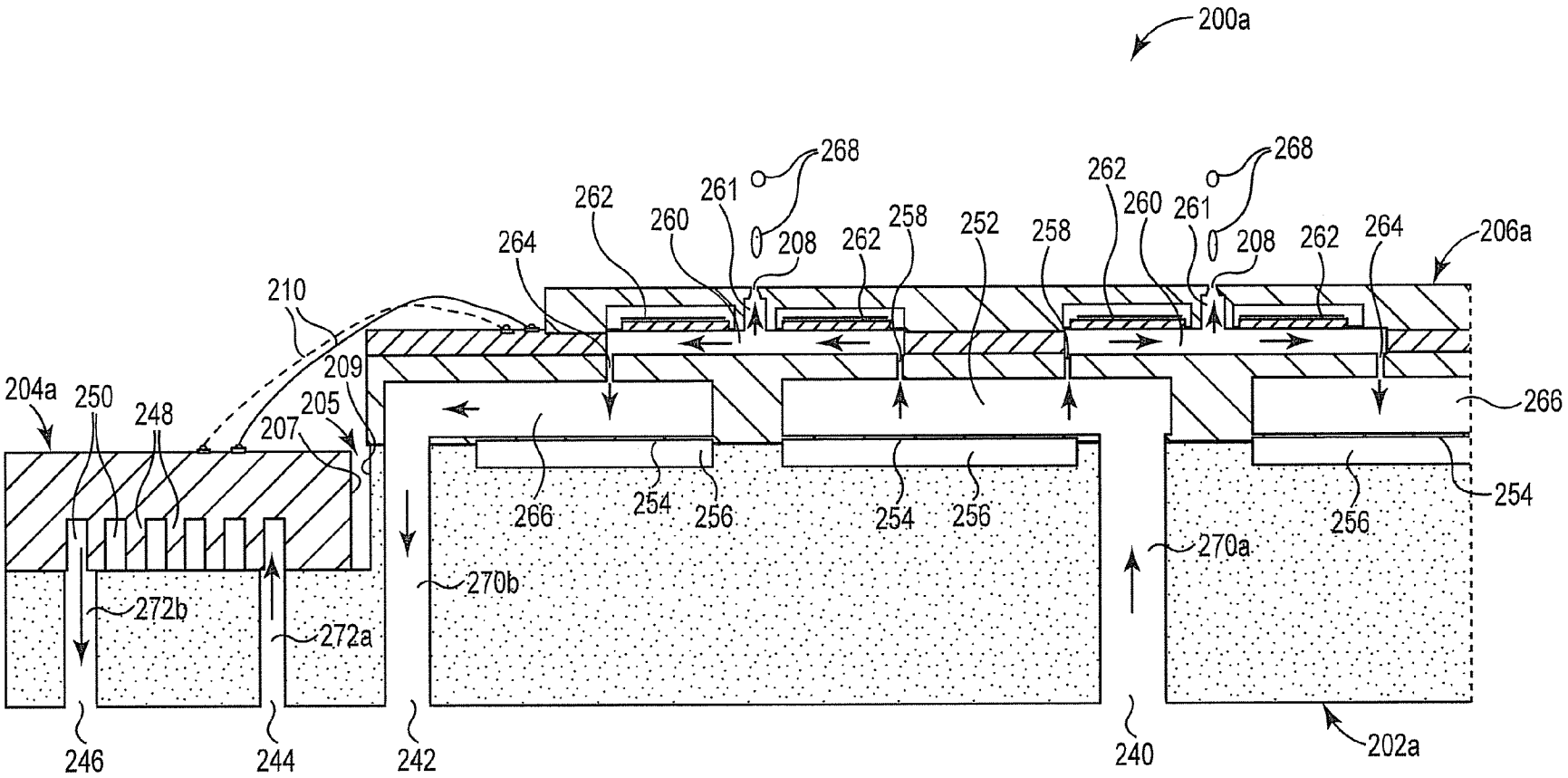
FIG. 3 illustrates a cross-sectional view of one example of one half of a PIJ printhead.

FIG. 3 illustrates a cross-sectional view of one example of one half of a PIJ printhead 200*a*. PIJ printhead 200*a* is one example of PIJ printhead 200 previously described and illustrated with reference to FIG. 2. PIJ printhead 200*a* includes one half of a substrate 202*a*, drive IC die 204*a*, and one half of a fluidics structure 206*a*. The other half of substrate 202*a* and fluidics structure 206*a* are similar to the illustrated portions shown in FIG. 3 and are therefore not shown for simplicity.

In this example substrate 202*a* includes an ink inlet 240, ink channels 270*a* and 270*b*, an ink outlet 242, a coolant inlet 244, coolant channels 272*a* and 272*b*, and a coolant outlet 246. Substrate 202*a* also includes air gaps 256. Substrate 202*a* includes a stepped substrate such that drive IC die 204*a* is arranged on a lower step of substrate 202*a* than fluidics structure 206*a*.

Drive IC die 204*a* is attached to substrate 202*a* via epoxy (not shown) or another suitable material such that there is a gap 205 between a sidewall 207 of drive IC die 204*a* and a sidewall 209 of substrate 202*a* and/or fluidics structure 206*a*. Gap 205 assists in isolating the heat generated by drive IC die 204*a* from fluidics structure 206*a*. Drive IC die 204*a* is electrically coupled to fluidics structure 206 via bond wires 210.

Coolant inlet 244 supplies coolant to drive IC die 204*a* via coolant channel 272*a*. The coolant is water, a water-solvent mixture, or another suitable non-ink cooling fluid. In one example, the coolant directly contacts drive IC die 204*a* for cooling the drive IC die 204*a*. The coolant passes through a heat exchange region at the base of drive IC die 204*a*. In one example, the heat exchange region of drive IC die 204*a* includes coolant channels 250 between fins 248 through which the coolant flows to cool drive IC die 204*a*. In this example, fins 248 run the length of drive IC die 204*a*. In other examples, however, fins 248 run the width of drive IC die 204*a* substantially perpendicular to the arrangement illustrated in FIG. 3. The coolant exits drive IC die 204*a* and flows to coolant outlet 246 via coolant channel 272*b*.

Fins 248 are formed in the backside of the semiconductor die. The surface of the semiconductor die that is in contact with the coolant may be chemically passivated. For example, a chemically resistant thin film coating may be grown or applied to the surfaces of fins 248. The coating may include silicon oxide, silicon nitride, tantalum, tantalum oxide, titanium nitride, or other suitable chemically resistant material. In one example, the coating has a thickness between 0.05 μm and 0.5 μm.

The flow of the coolant through substrate 202*a* and through the heat exchange region of drive IC die 204*a* is indicated by the arrows in coolant channels 272*a* and 272*b*. As indicated by the arrows, the coolant enters the heat exchange region of the drive IC die 204*a* on the side that is closer to fluidics structure 206*a*. The coolant exits the heat exchange region of the drive IC die 204*a* on the opposite side farthest from the fluidics structure 206*a*. In this way, the portion of drive IC die 204*a* that is closest to fluidics structure 206*a* remains cooler than the portion of drive IC die 204*a* that is farther away from fluidics structure 206*a*. Accordingly, the heat generated by drive IC die 204*a* does not adversely impact fluidics structure 206*a*.

Fluidics structure 206*a* includes a compliant film 254, an ink entrance manifold 252, ink exit manifolds 266, ink inlet ports 258, ink outlet ports 264, pressure chambers 260, piezoelectric actuators 262, descenders 261, and nozzles 208. The flow of the ink through substrate 202*a* and through fluidics structure 206*a* is indicated by arrows. Ink inlet 240 supplies ink to ink entrance manifold 252 of fluidics structure 206*a* via ink channel 270*a*. Ink entrance manifold 252 supplies ink to pressure chambers 260 via ink inlet ports 258. Ink pressure chambers 260 supply ink to descenders 261 for ejection through nozzles 208. Ink not ejected through nozzles 208 is recirculated to ink exit manifolds 266 via ink outlet ports 264. From ink exit manifolds 266, the ink exits ink outlet 242 via ink channel 270*b*. The ink is circulated through substrate 202*a* and fluidics structure 206*a* by external pumps in the ink supply assembly 104 (FIG. 1).

In one example, the inner two exit manifolds 266 share a common ink outlet (not shown). In another example, the inner two exit manifolds 266, compliant film 254, and air gaps 256 are isolated from each other by a centrally located wall partition (not shown) to allow two different color inks to circulate in a two color ink printhead.

Compliant film 254 is arranged on substrate 202*a* and spans air gaps 256 to alleviate pressure surges from pulsing ink flows through ink entrance manifold 252 and ink exit manifolds 266 due to start-up transients and ink ejections in adjacent nozzles, for example. Compliant film 254 has a damping effect on fluidic cross-talk between adjacent nozzles by being substantially located across from the ink inlet ports 258 and/or the ink outlet ports 264, as well as acting as a reservoir to ensure ink is available while flow is established from the ink supply during high volume printing. Air gaps 256 allow compliant film 254 to expand freely in response to fluid pressure surges in ink entrance manifold 252 and in ink exit manifolds 266.

Ink inlet ports 258 provide restriction points between ink entrance manifold 252 and pressure chambers 260. Ink outlet ports 264 provide restriction points between pressure chambers 260 and ink exit manifolds 266. The restriction points limit the flow of ink into and out of pressure chambers 260 for improving the efficiency of ink ejection through nozzles 208 when piezoelectric actuators 262 are activated.

Piezoelectric actuators 262 are arranged on a flexible membrane that defines the top of pressure chambers 260. Piezoelectric actuators 262 include a thin-film piezoelectric material such as a piezoceramic material that stresses mechanically in response to an applied electrical voltage. When activated by the circuit of drive IC die 204*a*, piezoelectric actuators 262 physically expand or contract, which generates pressure waves in pressure chambers 260 that eject ink drops 268 through nozzles 208. Piezoelectric actuators 262 are cooled by the ink flowing into and out of pressure chambers 260.

Figure 4:
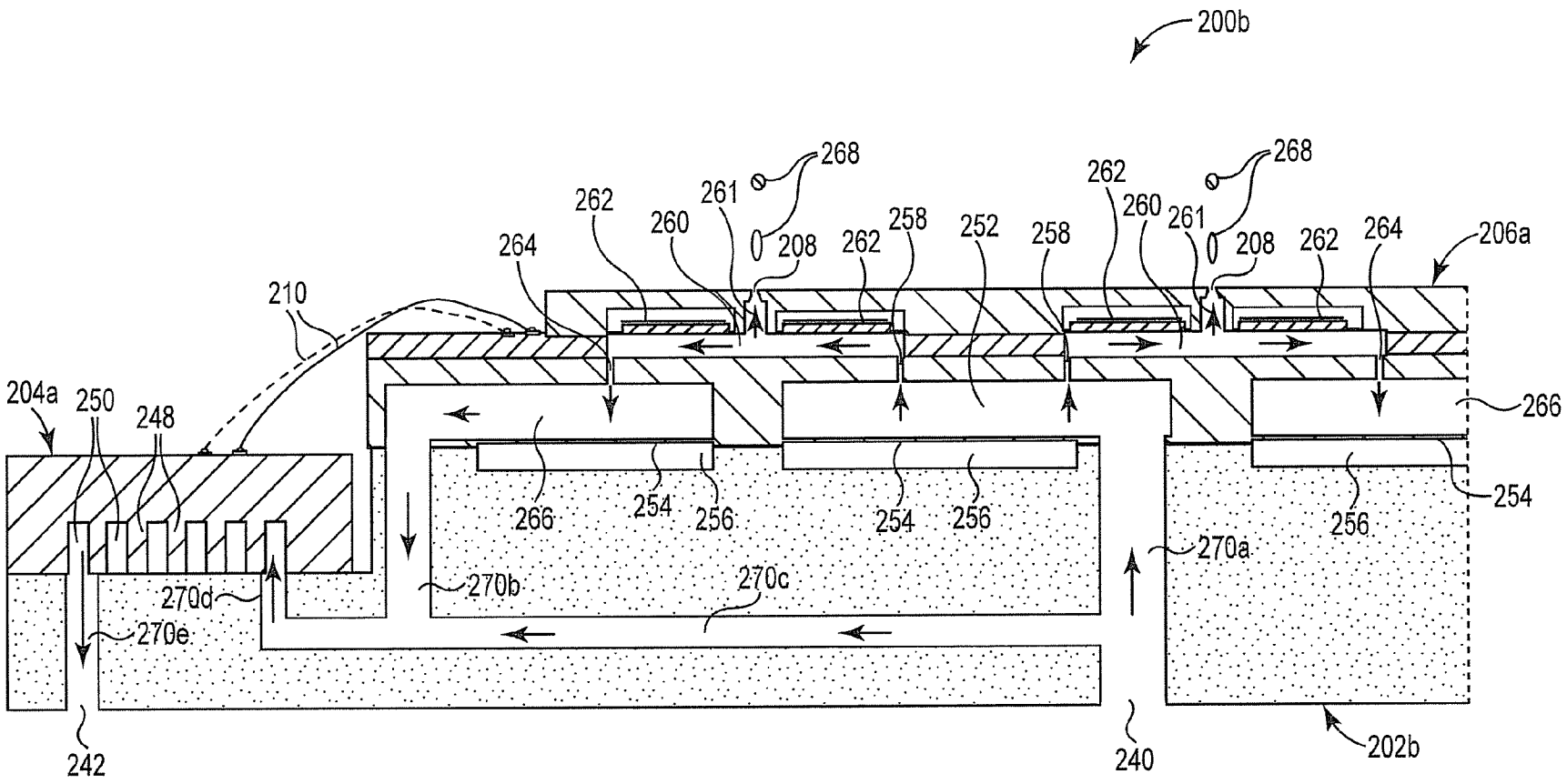
FIG. 4 illustrates a cross-sectional view of another example of one half of a PIJ printhead.

FIG. 4 illustrates a cross-sectional view of another example of one half of a PIJ printhead 200*b*. PIJ printhead 200*b* is similar to PIJ printhead 200*a* previously described and illustrated with reference to FIG. 3, except that in PIJ printhead 200*b*, drive IC die 204*a* is cooled by ink. In this example, a substrate 202*b* includes an ink inlet 240, an ink outlet 242, and ink channels 270*a*-270*e*.

The flow of the ink through substrate 202*b*, through fluidics structure 206*a*, and through the heat exchange region of drive IC die 204*a* is indicated by arrows. Ink inlet 240 supplies ink to ink entrance manifold 252 of fluidics structure 206*a* via ink channel 270*a*. The ink not ejected by fluidics structure 206*a* exits fluidics structure 206*a* through ink channel 270*b*. Ink inlet 240 also supplies ink to ink channel 270*c*, which bypasses fluidics structure 206*a*. In one example, bypass ink channel 270*c* has a fluidic resistance one half the fluidic resistance of pressure chambers 260. Therefore, two times more ink flows through bypass ink channel 270*c* than through pressure chambers 260. Bypass ink channel 270*c* provides a sufficient flow of ink to drive IC die 204*a* for cooling drive IC die 204*a*.

The ink from bypass ink channel 270*c* combines with ink exiting fluidics structure 206*a* from ink channel 270*b* in ink channel 270*d*. Ink channel 270*d* supplies ink to the heat exchange region of drive IC die 204*a*. In one example, the ink directly contacts drive IC die 204*a* for cooling the drive IC. The ink passes through channels 250 between fins 248 of drive IC die 204*a* to cool drive IC die 204*a*. In this example, fins 248 run the length of drive IC die 204*a*. In other examples, however, fins 248 run the width of drive IC die 204*a* substantially perpendicular to the arrangement illustrated in FIG. 4. The ink exits drive IC die 204*a* and flows to ink outlet 242 via ink channel 270*e*.

In one example, the inner two exit manifolds 266 share a common ink outlet (not shown). In another example, the inner two exit manifolds 266, compliant film 254, and air gaps 256 are isolated from each other by a centrally located wall partition (not shown) to allow two different color inks to circulate in a two color ink printhead.

Fins 248 are formed in the backside of the semiconductor die. The surface of the semiconductor die that is in contact with the ink may be chemically passivated. For example, a chemically resistant thin film coating may be grown or applied to the surfaces of fins 248. The coating may include silicon oxide, silicon nitride, tantalum, tantalum oxide, titanium nitride, or other suitable chemically resistant material. In one example, the coating has a thickness between 0.05 μm and 0.5 μm.

As indicated by the arrows, the ink enters the heat exchange region of the drive IC die 204*a* on the side that is closer to fluidics structure 206*a*. The ink exits the heat exchange region of the drive IC die 204*a* on the opposite side farthest from the fluidics structure 206*a*. In this way, the portion of drive IC die 204*a* that is closest to fluidics structure 206*a* remains cooler than the portion of drive IC die 204*a* that is farther away from fluidics structure 206*a*. Accordingly, the heat generated by drive IC die 204*a* does not adversely impact fluidics structure 206*a*.

Figure 5:
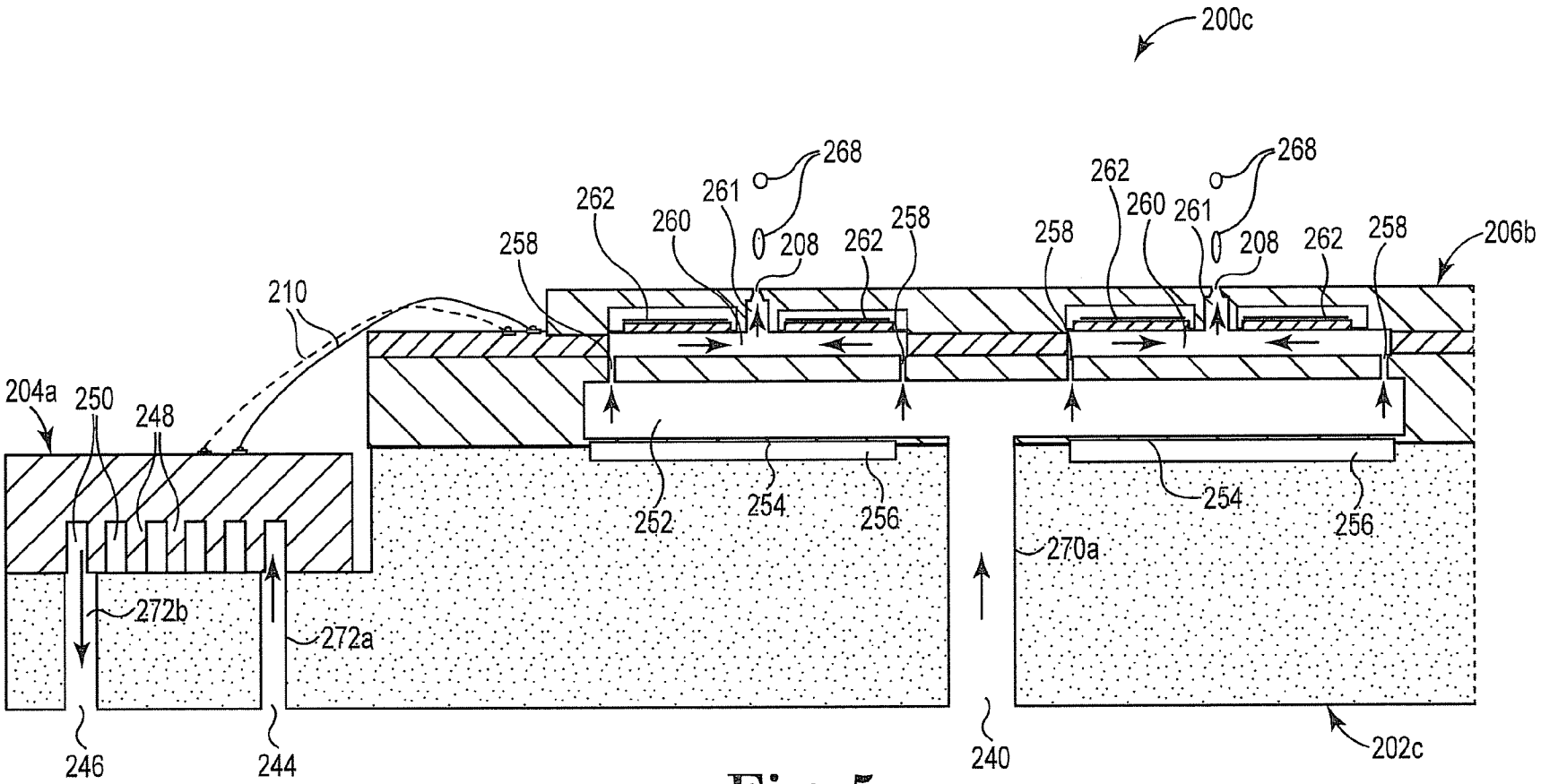
FIG. 5 illustrates a cross-sectional view of another example of one half of a PIJ printhead.

FIG. 5 illustrates a cross-sectional view of another example of one half of a PIJ printhead 200*c*. PIJ printhead 200*c* is similar to PIJ printhead 200*a* previously described and illustrated with reference to FIG. 3, except that PIJ printhead 200*c* does not recirculate ink. In this example, a substrate 202*c* includes an ink inlet 240, an ink channel 270*a*, a coolant inlet 244, a coolant outlet 246, and coolant channels 272*a* and 272*b*. A fluidics structure 206*b* includes a compliant film 254, ink entrance manifold 252, ink inlet ports 258, pressure chambers 260, piezoelectric actuators 262, descenders 261, and nozzles 208.

The flow of the ink through substrate 202*c* and through fluidics structure 206*b* is indicated by arrows. Ink inlet 240 supplies ink to ink entrance manifold 252 via ink channel 270*a*. Ink entrance manifold 252 supplies ink to pressure chambers 260 via inlet ports 258. Pressure chambers 260 supply ink to nozzles 208 via descenders 261. In this example, the ink flowing through pressure chambers 260 prior to ejection cools piezoelectric actuators 262. In addition, all the ink supplied to fluidics structure 206*b* is consumed during printing.

Figure 6:
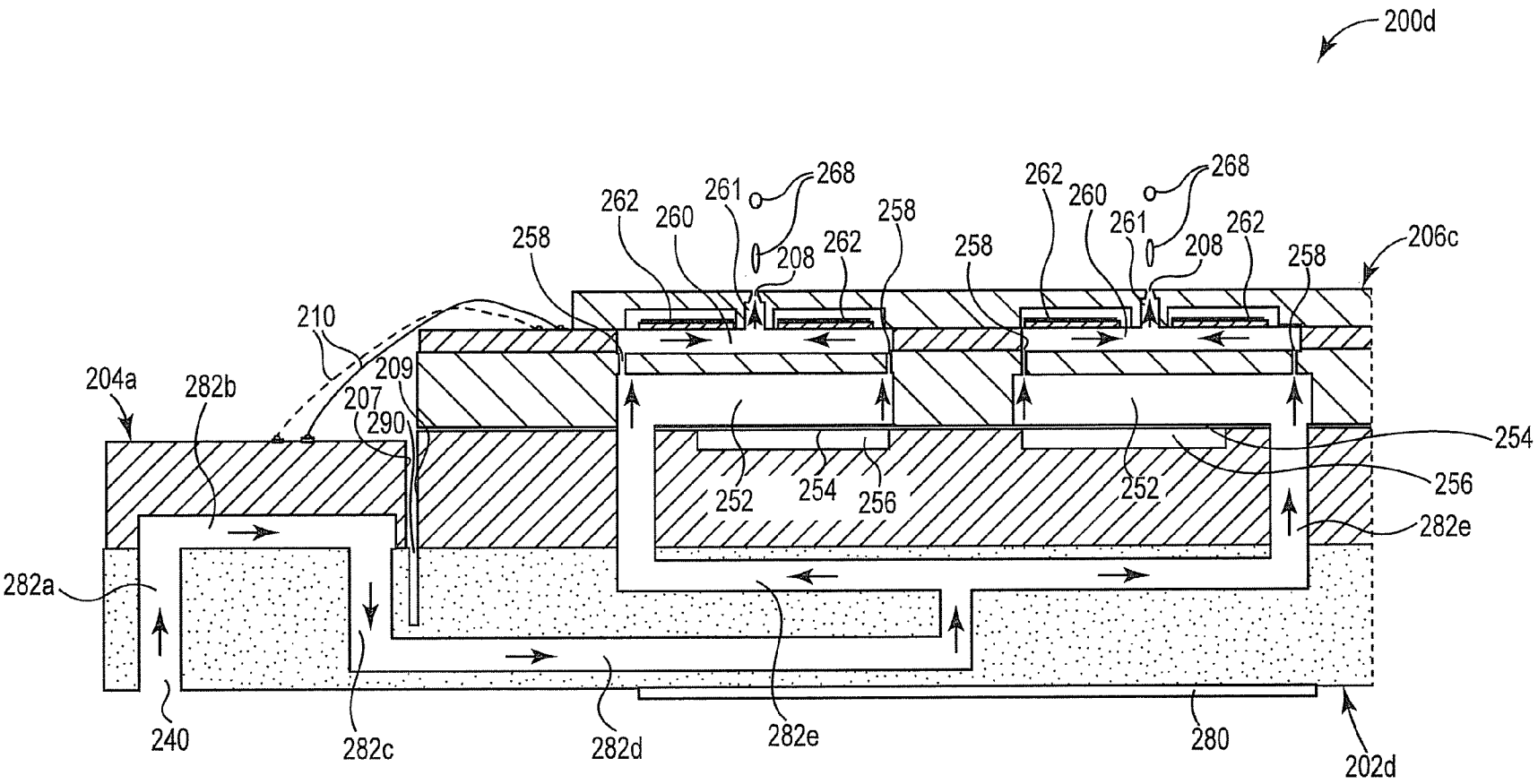
FIG. 6 illustrates a cross-sectional view of another example of one half of a PIJ printhead.

FIG. 6 illustrates a cross-sectional view of another example of one half of a PIJ printhead 200*d*. PIJ printhead 200*d* is similar to PIJ printhead 200*c* previously described and illustrated with reference to FIG. 5, except that in PIJ printhead 200*d* drive IC die 204*a* is cooled by ink. In this example, a substrate 202*d* includes an ink inlet 240, and ink channels 282*a*-282*e*. In one example, substrate 202*d* is made of a metal or a stack of metal layers. A fluidics structure 206*c* includes a compliant film 254, ink entrance manifolds 252, ink inlet ports 258, pressure chambers 260, piezoelectric actuators 262, descenders 261, and nozzles 208.

The flow of the ink through substrate 202*d* and through fluidics structure 206*c* is indicated by arrows. Ink inlet 240 supplies ink to the heat exchange region of drive IC die 204*a* via ink channel 282*a*. The ink cools drive IC die 204*a* as the ink flows through ink channel 282*b*. In one example, ink channel 282*b* flows between fins of the heat exchange region of drive IC die 204*a*. The ink exits drive IC die 204*a* through ink channel 282*c* and flows into ink channel 282*d*. Ink channel 282*d* supplies ink to ink entrance manifolds 252 via ink channels 282*e*.

In another example, the ink flow through substrate 202*d* includes a redirection channel (not shown). Ink enters beneath the drive IC die 204*a* at the end closer to the fluidics structure 206*c*. Ink flows to the heat exchange region of the drive IC die 204*a*. The heat exchange region of drive IC die 204*a* may include fins to enhance cooling. Ink leaves the drive IC die 204*a* at the end further from the fluidics structure 206*c* and out through a redirection channel to channels 282*e*. The ink exits the heat exchange region of the drive IC die 204*a* on the opposite side farthest from the fluidics structure 206*c*. In this way, the portion of drive IC die 204*a* that is closest to fluidics structure 206*c* remains cooler than the portion of drive IC die 204*a* that is farther away from fluidics structure 206*c*. Accordingly, the heat generated by drive IC die 204*a* does not adversely impact fluidics structure 206*c*. Additionally metal leaf springs (not shown) may aid heat removal by conduction to metal covers located above the drive IC die 204*a* (not shown).

In one example, a heating element 280 is attached to the bottom of substrate 202*d* or integrated within substrate 202*d* to further heat the ink as the ink flows through ink channels 282*d* and 282*e*. In this way, an ultraviolet (UV) curable or hot melt type ink may be jetted at elevated temperatures (e.g., 50° C. and/or 120° C.) by printhead 200*d*. The ink is warmed by the heat from drive IC die 204*a* and then further heated to the final operating temperature by heating element 280.

In one example, a slot 290 extends into substrate 202*d* between sidewall 207 of drive IC die 204*a* and sidewall 209 of fluidics structure 206*c* and substrate 202*d*. Slot 290 further assists in isolating the heat generated by drive IC die 204*a* from fluidics structure 206*c*.

Figure 7:
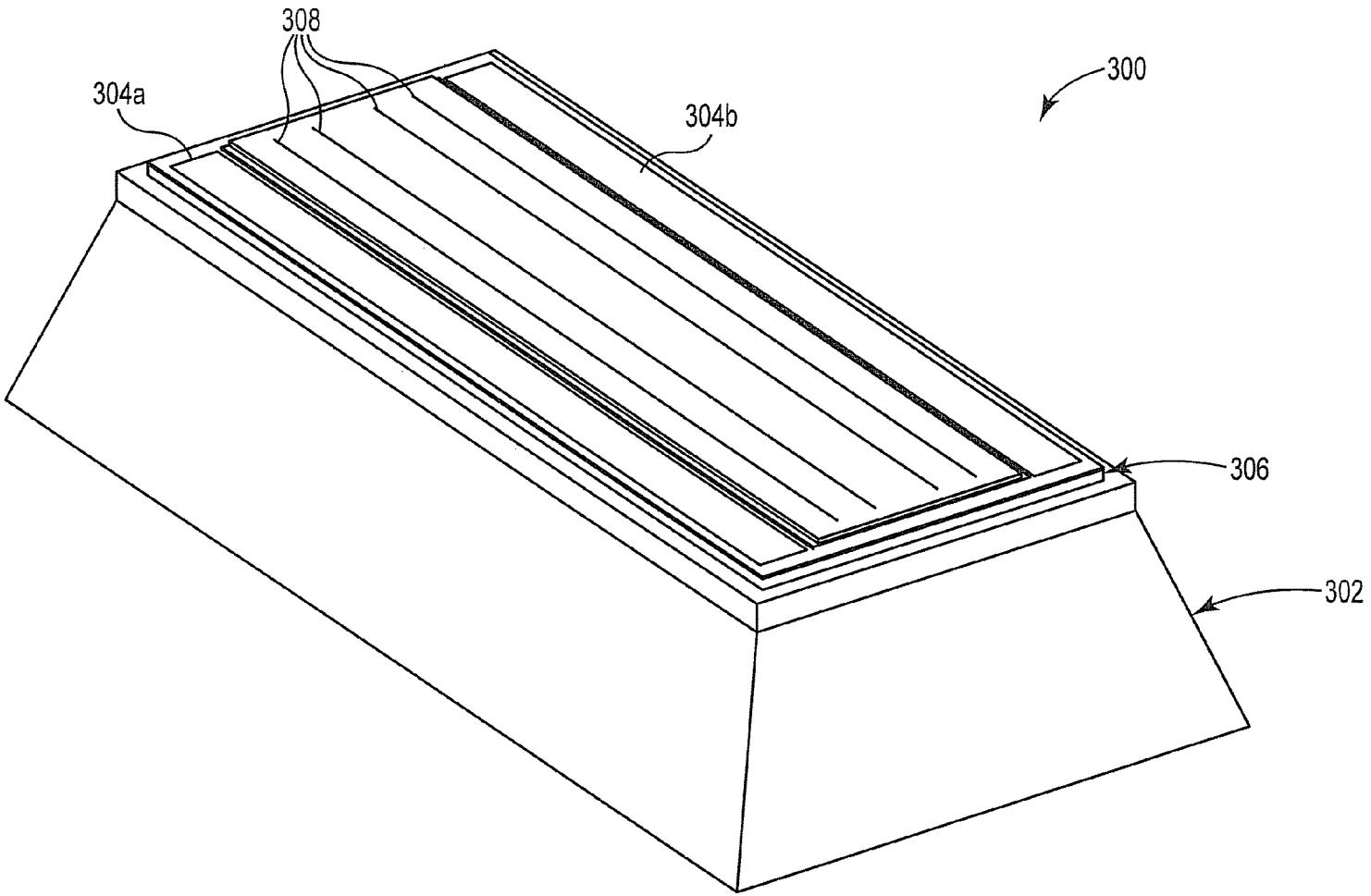
FIG. 7 is a diagram illustrating another example of a PIJ printhead.

FIG. 7 is a diagram illustrating another example of a PIJ printhead 300. In one example, PIJ printhead 300 is used for printhead 114 previously described and illustrated with reference to FIG. 1. PIJ printhead 300 includes a die stack including a substrate 302 and a fluidics structure 306. In this example, in place of separate drive IC dies as illustrated in FIGS. 2-6, drive ICs 304*a* and 304*b* are formed on one die of the die stack on which a portion of the fluidics structure 306 is also formed.

In one example, substrate 302 is a multilayer substrate including a plurality of stacked substrate dies, such as a polymer-stainless substrate die stack. Substrate 302 is wider at the base than at the top where fluidics structure 306 is attached. Fluidics structure 306 also includes a plurality of stacked dies. Each layer of the die stack that provides printhead 300 includes fluid passageways, such as slots, channels, or holes for routing ink and/or coolant to and/or from the fluidics structure 306. Fluidics structure 306 is stacked on and substantially centered on substrate 302. Fluidics structure 306 includes a plurality of piezoelectric actuators (not shown) and a plurality of corresponding nozzles 308. In one example, fluidics structure 306 includes 1200 nozzles in four columns of 300. In other examples, fluidics structure 306 includes another suitable number of nozzles arranged in another suitable number of columns. In one example, PIJ printhead 300 is half the width of the example PIJ printhead 200 previously described and illustrated with reference to FIG. 2.

Figure 8:
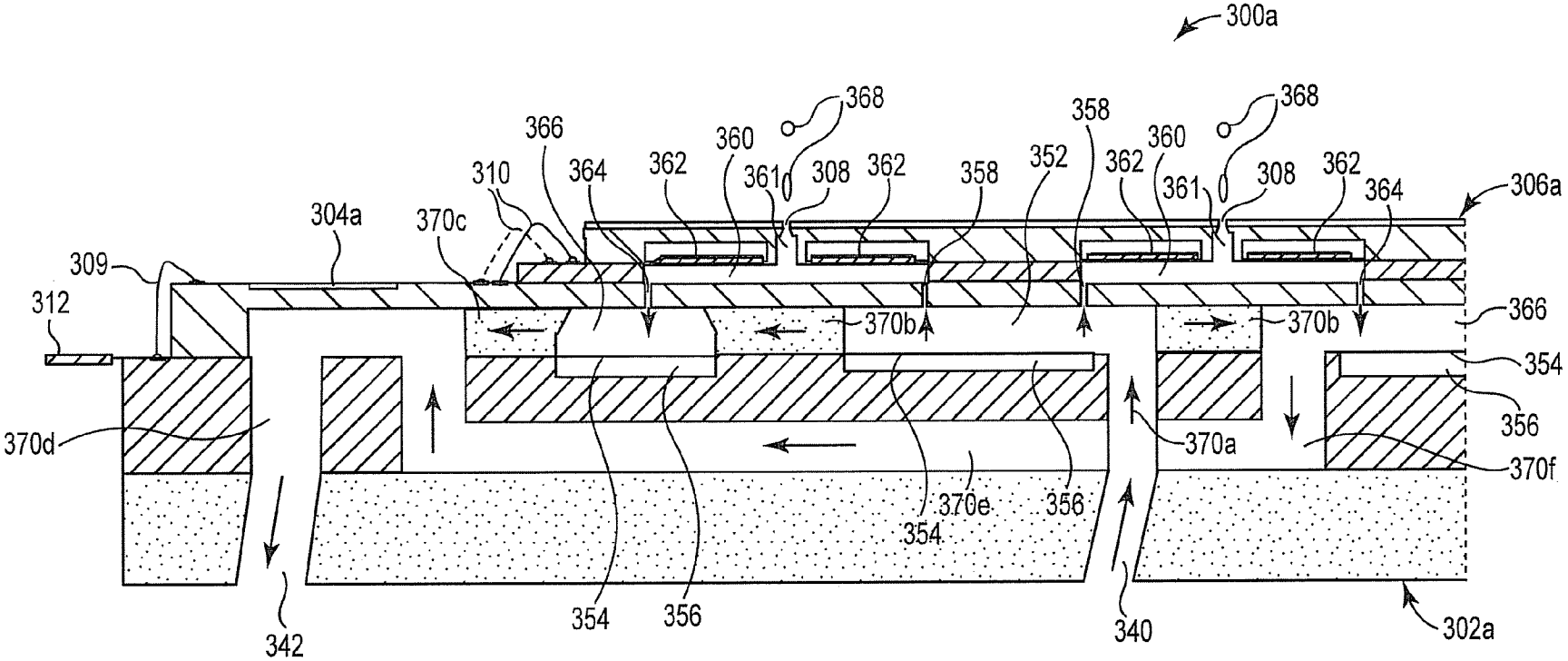
FIG. 8 illustrates a cross-sectional view of another example of one half of a PIJ printhead.

FIG. 8 illustrates a cross-sectional view of another example of one half of a PIJ printhead 300*a*. PIJ printhead 300*a* is one example of PIJ printhead 300 previously described and illustrated with reference to FIG. 7. PIJ printhead 300*a* includes one half of a substrate 302*a* and one half of a fluidics structure 306*a*. The other half of substrate 302*a* and fluidics structure 306*a* are similar to the illustrated portions shown in FIG. 8 and are therefore not shown for simplicity.

In this example, substrate 302*a* includes an ink inlet 340, ink channels 370*a*, 370*d*, 370*e*, and 370*f*, and an ink outlet 342. Substrate 302*a* also includes air gaps 356. Fluidics structure 306*a* includes a compliant film 354, an ink entrance manifold 352, ink exit manifolds 366, ink channels 370*b* and 370*c*, ink inlet ports 358, ink outlet ports 364, pressure chambers 360, piezoelectric actuators 362, descenders 361, and nozzles 308. Drive IC 304*a* is formed on a die that also provides a portion of fluidics structure 306*a*. In particular, drive IC 304*a* is formed on the same die in which ink inlet ports 358 and ink outlet ports 364 are formed. Drive IC 304*a* is electrically coupled to fluidics structure 306*a* via bond wires 310 for controlling the piezoelectric actuators 362 of fluidics structure 306*a*. A flex connector 312 is electrically coupled to drive IC 304*a* via bond wires 309. Flex connector 312 supplies power and control signals to drive IC 304*a* for operating PIJ printhead 300*a*.

The flow of the ink through substrate 302*a*, through fluidics structure 306*a*, and through the heat exchange region under drive IC 304*a* is indicated by arrows. Ink inlet 340 supplies ink to ink entrance manifold 352 of fluidics structure 306*a* via ink channel 370*a*. Ink entrance manifold 352 supplies ink to pressure chambers 360 via ink inlet ports 358. Ink entrance manifold 352 also supplies ink to ink exit manifolds 366 via ink channels 370*b*, which bypass pressure chambers 360. Bypass ink channels 370*b* include pinchpoints for creating the appropriate flow resistance, such as one half that of the pressure chambers, inlets, and outlets. Ink pressure chambers 360 supply ink to descenders 361 for ejection through nozzles 308. Ink not ejected through nozzles 308 is recirculated to ink exit manifolds 366 via ink outlet ports 364. From the inner ink exit manifold 366, the ink is recirculated through ink channel 370*f*. The ink in ink channel 370*f* flows into ink channel 370*e*.

From the outer ink exit manifold 366, the ink flows under drive IC 304*a* via ink channel 370*c*, which cools drive IC 304*a*. Ink channel 370*c* includes a pinchpoint for creating the appropriate flow resistance. In addition, the ink from ink channel 370*e* combines with ink from ink channel 370*c* under drive IC 304*a*. In one example, the ink passes through channels between fins of the die on which drive IC 304*a* is formed to cool drive IC 304*a*. The ink exits the heat exchange region under drive IC 304*a* and flows to ink outlet 342 via ink channel 370*d*. The ink is circulated through substrate 302*a* and fluidics structure 306*a* by external pumps in the ink supply assembly 104 (FIG. 1).

In another example, the inner two exit manifolds 366, compliant film 354, and air gaps 356 are isolated from each other by a centrally located wall partition (not shown) to allow two different color inks to circulate in a two color ink printhead.

Compliant film 354 is arranged on substrate 302*a* and spans air gaps 356 to alleviate pressure surges from pulsing ink flows through ink entrance manifold 352 and ink exit manifolds 366 due to start-up transients and ink ejections in adjacent nozzles, for example. Compliant film 354 has a damping effect on fluidic cross-talk between adjacent nozzles, as well as acting as a reservoir to ensure ink is available while flow is established from the ink supply during high volume printing. Air gaps 356 allow compliant film 354 to expand freely in response to fluid pressure surges in ink entrance manifold 352 and ink exit manifolds 366.

Ink inlet ports 358 provide restriction points between ink entrance manifold 352 and pressure chambers 360. Ink outlet ports 364 provide restriction points between pressure chambers 360 and ink exit manifolds 366. The restriction points limit the flow of ink into and out of pressure chambers 360 for improving the efficiency of ink ejection through nozzles 308 when piezoelectric actuators 362 are activated.

Piezoelectric actuators 362 are arranged on a flexible membrane that defines the top of pressure chambers 360. Piezoelectric actuators 362 include a thin-film piezoelectric material such as a piezoceramic material that stresses mechanically in response to an applied electrical voltage. When activated by drive IC 304*a*, piezoelectric actuators 362 physically expand or contract, which generates pressure waves in pressure chambers 360 that eject ink drops 368 through nozzles 308. Piezoelectric actuators 362 are cooled by the ink flowing into and out of pressure chambers 360.

Figure 9:
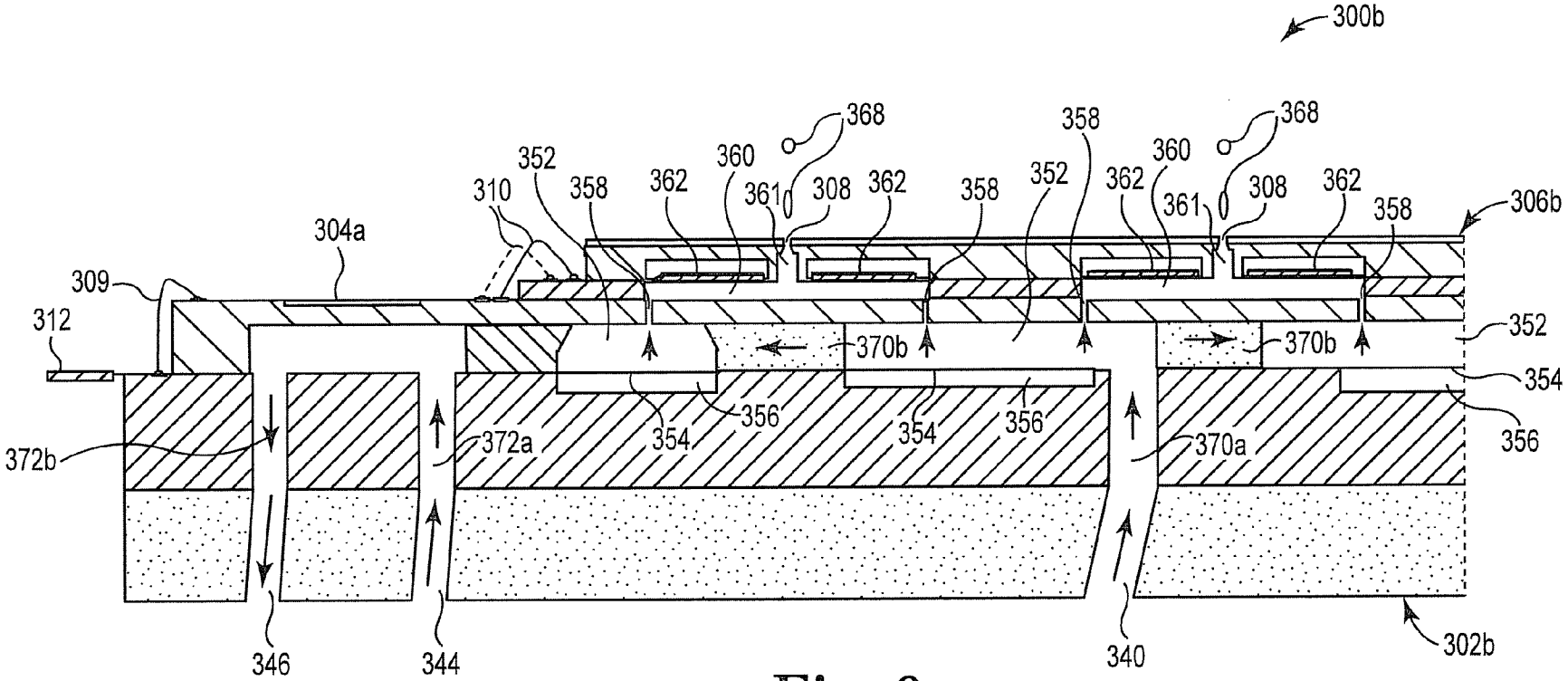
FIG. 9 illustrates a cross-sectional view of another example of one half of a PIJ printhead.

FIG. 9 illustrates a cross-sectional view of another example of one half of a PIJ printhead 300*b*. PIJ printhead 300*b* is similar to PIJ printhead 300*a* previously described and illustrated with reference to FIG. 8, except that PIJ printhead 300*b* includes a coolant for cooling drive IC 304*a* and does not recirculate ink. In this example, a substrate 302*b* includes an ink inlet 340, an ink channel 370*a*, a coolant inlet 344, a coolant outlet 346, and coolant channels 372*a* and 372*b*. A fluidics structure 306*b* includes a compliant film 354, an ink entrance manifold 352, ink inlet ports 358, pressure chambers 360, piezoelectric actuators 362, descenders 361, and nozzles 308.

The flow of the ink through substrate 302*b* and through fluidics structure 306*b* is indicated by arrows. Ink inlet 340 supplies ink to ink entrance manifold 352 via ink channel 370*a*. Ink entrance manifold 352 supplies ink to pressure chambers 360 via ink inlet ports 358. Pressure chambers 360 supply ink to nozzles 308 via descenders 361. In this example, the ink flowing through pressure chambers 360 prior to ejection cools piezoelectric actuators 362. In addition, all ink supplied to fluidics structure 306*b* is consumed during printing.

In another example, the inner two ink entrance manifolds 352, compliant film 354, and air gaps 356 are isolated from each other by a centrally located wall partition (not shown) to allow two different color inks to flow in a two color ink printhead.

Coolant inlet 344 supplies coolant to drive IC 304*a* via coolant channel 372*a*. The coolant is water, a water-solvent mixture, or another suitable non-ink cooling fluid. In one example, the coolant directly contacts the die on which drive IC 304*a* is formed for cooling the drive IC. The coolant passes through a heat exchange region under drive IC 304*a*. In one example, the heat exchange region under drive IC 304*a* includes coolant channels between fins through which the coolant flows to cool drive IC 304*a*. The coolant exits from under drive IC 304*a* and flows to coolant outlet 346 via coolant channel 372*b*.

The flow of the coolant through substrate 302*b* and through the heat exchange region under drive IC 304*a* is indicated by the arrows in coolant channels 372*a* and 372*b*. As indicated by the arrows, the coolant enters the heat exchange region under drive IC 304*a* on the side that is closer to fluidics structure 306*b*. The coolant exits the heat exchange region under drive IC 304*a* on the opposite side farthest from the fluidics structure 306*b*. In this way, the portion of drive IC 304*a* that is closest to fluidics structure 306*b* remains cooler than the portion of drive IC 304*a* that is farther away from fluidics structure 306*b*. Accordingly, the heat generated by drive IC 304*a* does not adversely impact fluidics structure 306*b*.

Figure 10:
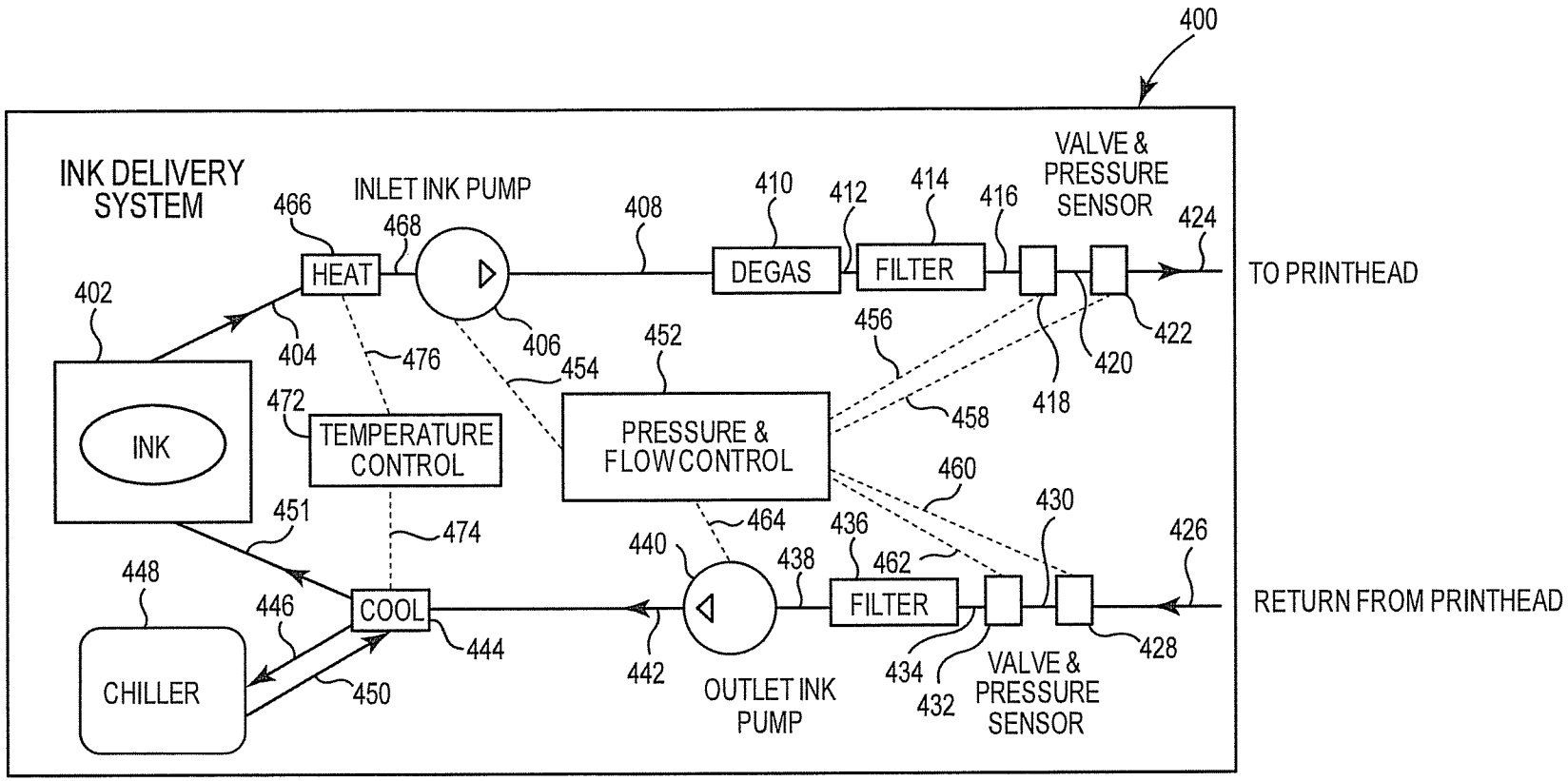
FIG. 10 is a block diagram illustrating one example of an ink delivery system.

FIG. 10 is a block diagram illustrating one example of an ink delivery system 400. In one example, ink delivery system 400 provides ink supply assembly 104 and ink conditioning assembly 105 previously described and illustrated with reference to FIG. 1. Ink delivery system 400 is applicable to PIJ printhead 200*b* previously described and illustrated with reference to FIG. 4 and PIJ printhead 300*a* previously described and illustrated with reference to FIG. 8. Ink delivery system 400 includes an ink supply 402, a heater 466, an inlet ink pump 406, a degassing device 410, an inlet filter 414, an inlet valve 418, an inlet pressure sensor 422, a cooler 444, a chiller 448, an outlet ink pump 440, an outlet filter 436, an outlet valve 432, an outlet pressure sensor 428, a temperature control circuit 472, and a pressure and flow control circuit 452.

Ink supply 402 is in fluid communication with heater 466 through ink path 404, Heater 466 is in fluid communication with inlet ink pump 406 though ink path 468. Inlet ink pump 406 is in fluid communication with degassing device 410 through ink path 408. Degassing device 410 is in fluid communication with inlet filter 414 through ink path 412. Inlet filter 414 is in fluid communication with inlet valve 418 through ink path 416. Inlet valve 418 is in fluid communication with inlet pressure sensor 422 through ink path 420. In another example, the arrangement of inlet valve 418 and inlet pressure sensor 422 is reversed such that inlet pressure sensor 422 is between inlet filter 414 and inlet valve 418. Inlet pressure sensor 422 is in fluid communication with the printhead through ink path 424.

The printhead is in fluid communication with outlet pressure sensor 428 through ink path 426. Outlet pressure sensor 428 is in fluid communication with outlet valve 432 through ink path 430. Outlet valve 432 is in fluid communication with outlet filter 436 through ink path 434. In another example, the arrangement of outlet valve 432 and outlet pressure sensor 428 is reversed such that outlet pressure sensor 428 is between outlet filter 436 and outlet valve 432. Outlet filter 436 is in fluid communication with outlet ink pump 440 through ink path 438. Outlet ink pump 440 is in fluid communication with cooler 444 through ink path 442. In one example, cooler 444 is in fluid communication with chiller 448 through ink paths 446 and 450. Cooler 444 is in fluid communication with ink supply 402 through ink path 451. In another example, cooler 444 is located between ink supply 402 and inlet ink pump 406. In another example, outlet filter 436 is excluded, and outlet valve 432 or outlet pressure sensor 428 is in fluid communication with outlet pump 440.

Temperature control circuit 472 is communicatively coupled to heater 466 through signal path 476 and to cooler 444 through signal path 474. Pressure and flow control circuit 452 is communicatively coupled to inlet ink pump 406 through signal path 454, to inlet valve 418 through signal path 456, and to inlet pressure sensor 420 through signal path 458. Pressure and flow control circuit 452 is also communicatively coupled to outlet ink pump 440 through signal path 464, to outlet valve 432 through signal path 462, and to outlet pressure sensor 428 through signal path 460.

In operation, pressure and flow control circuit 452 controls inlet ink pump 406, inlet valve 418, outlet ink pump 440, and outlet valve 432 to supply ink to the printhead based on pressure feedback received from inlet pressure sensor 422 and outlet pressure sensor 428. Inlet ink pump 406 pumps ink from ink supply 402 through degassing device 410, inlet filter 414, inlet valve 418, and inlet pressure sensor 422 to the printhead. Outlet ink pump 440 pumps ink from the printhead through outlet pressure sensor 428, outlet valve 432, and outlet filter 436 to temperature control device 444. Temperature control circuit 472 controls heater 466 and cooler 444 to control the temperature of the ink. Cooler 444 cools the ink using chiller 448 and/or heater 466 heats the ink to achieve the proper operating temperature.

Figure 11:
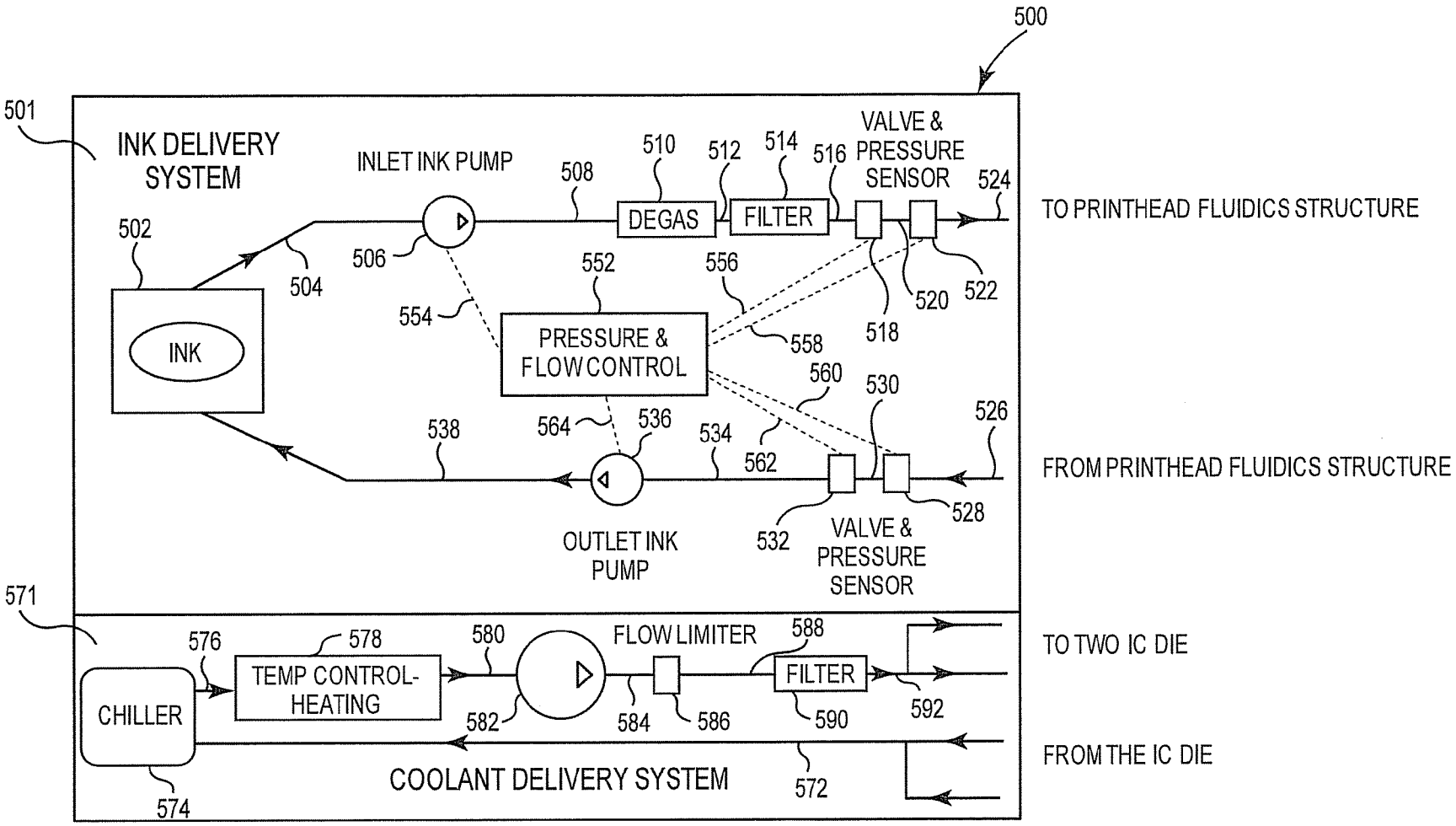
FIG. 11 is a block diagram illustrating one example of an ink and coolant delivery system.

FIG. 11 is a block diagram illustrating one example of an ink and coolant delivery system 500. In one example, ink and coolant delivery system 500 provides ink supply assembly 104 and ink conditioning assembly 105 previously described and illustrated with reference to FIG. 1. Ink and coolant delivery system 500 is applicable to PIJ printhead 200*a* previously described and illustrated with reference to FIG. 3. Ink and coolant delivery system 500 includes an ink delivery system 501 and a coolant delivery system 571. Ink delivery system 501 includes an ink supply 502, an inlet ink pump 506, a degassing device 510, an inlet filter 514, an inlet valve 518, an inlet pressure sensor 522, an outlet ink pump 536, an outlet valve 532, an outlet pressure sensor 528, and a pressure and flow control circuit 552. In another example, an outlet filter may be present before outlet pump 536.

Ink supply 502 is in fluid communication with inlet ink pump 506 though ink path 504. Inlet ink pump 506 is in fluid communication with degassing device 510 through ink path 508. Degassing device 510 is in fluid communication with inlet filter 514 through ink path 512. Inlet filter 514 is in fluid communication with inlet valve 518 through ink path 516. Inlet valve 518 is in fluid communication with inlet pressure sensor 522 through ink path 520. In another example, the arrangement of inlet valve 518 and inlet pressure sensor 522 is reversed such that inlet pressure sensor 522 is between inlet filter 514 and inlet valve 518. Inlet pressure sensor 522 is in fluid communication with the printhead through ink path 524.

The printhead is in fluid communication with outlet pressure sensor 528 through ink path 526. Outlet pressure sensor 528 is in fluid communication with outlet valve 532 through ink path 530. Outlet valve 532 is in fluid communication with outlet ink pump 536 through ink path 534. In another example, the arrangement of outlet valve 532 and outlet pressure sensor 528 is reversed such that outlet pressure sensor 528 is between outlet ink pump 536 and outlet valve 532. Outlet ink pump 536 is in fluid communication with ink supply 502 through ink path 538.

Pressure and flow control circuit 552 is communicatively coupled to inlet ink pump 506 through signal path 554, to inlet valve 518 through signal path 556, and to inlet pressure sensor 522 through signal path 558. Pressure and flow control circuit 552 is also communicatively coupled to outlet ink pump 536 through signal path 564, to outlet valve 532 through signal path 562, and to outlet pressure sensor 528 through signal path 560.

In operation, pressure and flow control circuit 552 controls inlet ink pump 506, inlet valve 518, outlet ink pump 536, and outlet valve 532 to supply ink to the printhead based on pressure feedback received from inlet pressure sensor 522 and outlet pressure sensor 528. Inlet ink pump 506 pumps ink from ink supply 502 through degassing device 510, inlet filter 514, inlet valve 518, and inlet pressure sensor 522 to the printhead. Outlet ink pump 536 pumps ink from the printhead through outlet pressure sensor 528 and outlet valve 532 to ink supply 502.

Coolant delivery system 571 includes a chiller 574, a temperature control device 578, a pump 582, a flow limiter 586, and a filter 590. Chiller 574 is in fluid communication with temperature control device 578 through coolant path 576. The heat may be removed in chiller 574 via a heat exchanger that uses water, refrigerant fluid, or air as the cooling medium. Temperature control device 578 is in fluid communication with pump 582 through coolant path 580. Pump 582 is in fluid communication with flow limiter 586 through coolant path 584. Flow limiter 586 is in fluid communication with filter 590 through coolant path 588. Filter 590 is in fluid communication with the two drive IC dies through coolant path 592. The two drive IC dies are in fluid communication with chiller 574 through coolant path 572.

In operation, pump 582 circulates coolant through flow limiter 586, filter 590, the two drive IC dies, chiller 574, and temperature control device 578. Chiller 574 cools the coolant as the coolant flow through chiller 574. Temperature control device 578 controls the temperature of the coolant including heating the coolant if necessary.

There are trade-offs between cooling the drive IC with ink verses cooling the drive IC with a non-ink coolant. A non-ink coolant can have a higher heat capacity than ink such that the flow rate of a non-ink coolant may be less than a flow rate for ink cooling. Non-ink cooling uses more passages since passages for both non-ink coolant and ink have to be provided. Ink cooling uses a separate temperature control system for each color of ink; whereas, non-ink cooling uses only one cooling system for all colors of ink across multiple printheads. Pumps are more expensive for ink cooling with ink recirculation since the volume of ink pumped is three to five times greater than for non-ink cooling. Finally, the control of the backpressure in the pressure chamber during ejection of ink is more difficult with ink recirculation in combination with ink cooling compared to non-ink cooling.

Figure 12A:
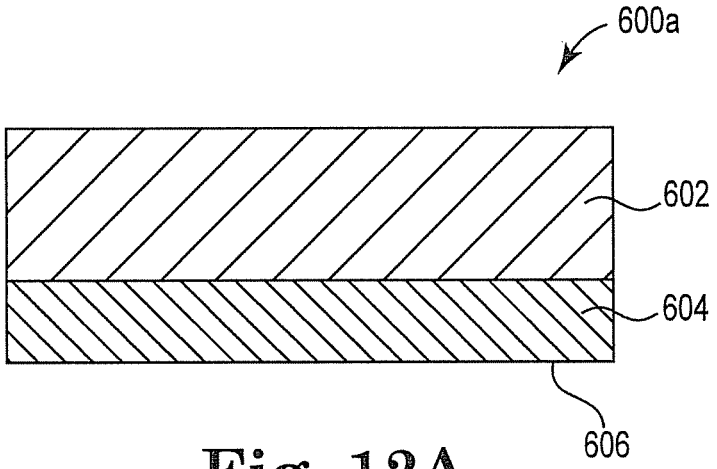
FIG. 12A illustrates a cross-sectional view of one example of a drive integrated circuit (IC) die stack.

FIG. 12A illustrates a cross-sectional view of one example of a drive IC die stack 600*a*. In one example, drive IC die stack 600*a* is used for drive IC die 204*a* previously described and illustrated with reference to FIGS. 2-6. Drive IC die stack 600*a* includes a drive IC die 602 and an interposer 604. In one example, drive IC die 602 is a silicon die. In one example, interposer 604 is a metal layer, such as a stainless steel, copper, copper alloy, or aluminum layer. In another example, interposer 604 is another suitable material having a greater thermal conductivity than silicon.

Interposer 604 is bonded to drive IC die 602 via an adhesive material layer. In one example, the thickness of the adhesive material layer is less than or equal to 1 μm to provide good heat transfer between drive IC die 602 and interposer 604. The adhesive material can be an epoxy or another suitable material. In one example, the adhesive material may be applied with a stamp or roller. In another example, an inkjet may be used to deposit the adhesive. The adhesive should be applied such that the bond between drive IC die 602 and interposer 604 is free of voids.

The surface 606 of interposer 604 may be chemically passivated. For example, a chemically resistant thin film coating may be grown or applied to surface 606. The coating may include an anodized layer, a polymer layer, a parylene layer, or another suitable chemically resistant material layer. In one example, the coating is less the 0.5 μm thick. For interposers made from stainless steel or other insert materials, the coating can be excluded.

Interposer 604 is arranged between drive IC die 602 and the coolant or ink used to cool the drive IC die. In one example, interposer 604 protects drive IC die 602 from the coolant or ink. The interposer 604 and/or the coating on surface 606 of interposer 604 provide corrosion resistance to the coolant or ink. In another example, interposer 604 also enhances the transfer of heat from drive IC die 602 to the coolant or ink.

Figure 12B:
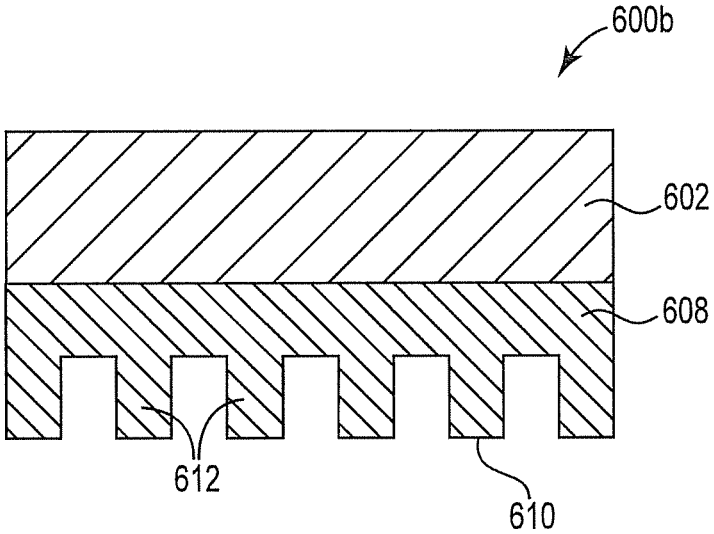
FIG. 12B illustrates a cross-sectional view of another example of a drive IC die stack.

FIG. 12B illustrates a cross-sectional view of another example of a drive IC die stack 600*b*. In one example, drive IC die stack 600*b* is used for drive IC die 204*a* previously described and illustrated with reference to FIGS. 2-6. Drive IC die stack 600*b* is similar to drive IC die stack 600*a* previously described and illustrated with reference to FIG. 12A, except that in drive IC die stack 600*b*, interposer 604 is replaced with an interposer 608.

In this example, interposer 608 includes fins 612 that spread out the heat from drive IC die 602, thus providing more surface area for efficient heat removal from drive IC die 602. The surface 610 of interposer 608 including the surfaces between fins 612 may be chemically passivated similar to surface 606 of interposer 604 (FIG. 12A). Examples of the disclosure provide printheads including a common substrate for routing ink and/or non-ink coolant to heat exchange regions of drive ICs sharing the common substrate with the fluidics structure of the printhead. By cooling the drive ICs in this manner, the constraints on the number of pulses per pixel may be minimized, the maximum frequency of jetting may be increased (i.e., a higher media speed is possible), the number of jets ejecting drops simultaneously may be increased, low heat capacity fluids may be used for jetting, and the overall drop speed as determined by the pulse amplitude may be increased. In addition, the printhead temperatures are more uniform, which results in more uniform drop speeds and weights since ink viscosity and piezoceramic efficiency are sensitive to temperature.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. A printhead comprising:

a substrate;

a fluidics structure attached to the substrate, the fluidics structure comprising actuators for ejecting ink from the printhead; and an integrated circuit die attached to the substrate, the integrated circuit die for driving the actuators, the integrated circuit die cooled by a coolant contacting the integrated circuit die and flowing through the substrate.

2. The printhead of claim 1, wherein the coolant comprises a non-ink fluid, wherein the substrate comprises an ink inlet for supplying ink to the fluidics structure and an ink outlet for recirculating ink from the fluidics structure, and wherein the substrate comprises a coolant inlet and a coolant outlet for supplying coolant to the integrated circuit die.

3. The printhead of claim 2, where the coolant inlet is closer to the fluidic structure than the coolant outlet.

4. The printhead of claim 1, wherein the coolant comprises a non-ink fluid, wherein the substrate comprises an ink inlet for supplying ink to the fluidics structure, and wherein the substrate comprises a coolant inlet and a coolant outlet for supplying coolant to the integrated circuit die.

5. The printhead of claim 1, wherein the coolant comprises ink.

6. The printhead of claim 5, wherein the substrate comprises an ink inlet and an ink outlet for supplying ink to the fluidics structure and the integrated circuit die, and wherein the substrate comprises a bypass ink channel for supplying ink to the integrated circuit die from the ink inlet while bypassing the fluidics structure.

7. The printhead of claim 1, wherein the substrate comprises ink channels such that the ink flows from the fluidics structure to the integrated circuit die or from the integrated circuit die to the fluidics structure.

8. The printhead of claim 1, wherein the fluidics structure and the integrated circuit die are formed in a single die stack.

9. A printhead comprising:

a substrate die stack;

a fluidics die stack attached to the substrate, the fluidics die stack comprising actuators for ejecting ink from the printhead, the actuators cooled by ink flowing through the fluidics die stack; and an integrated circuit die attached to the substrate on each side of the fluidics die stack, each integrated circuit die for driving the actuators, each integrated circuit die cooled by a coolant contacting the integrated circuit die and flowing through the substrate die stack.

10. The printhead of claim 9, wherein each integrated circuit die is attached to the substrate via an interposer for protecting the integrated circuit die from the coolant.

11. The printhead of claim 9, wherein the coolant comprises a non-ink fluid, and wherein each integrated circuit die is cooled by the non-ink fluid flowing from a first side of each integrated circuit die to a second side of each integrated circuit die, each first side closer to the fluidics die stack than each second side.

12. A method for cooling a printhead, the method comprising:

supplying ink to a fluidics structure through a substrate on which the fluidics structure is attached; and supplying coolant to an integrated circuit die through the substrate on which the integrated circuit die is also attached.

13. The method of claim 12, wherein the coolant comprises a non-ink fluid, and wherein supplying coolant to the integrated circuit die comprises supplying the non-ink fluid to the integrated circuit die through coolant channels of the substrate from a first side of the integrated circuit die to a second side of the integrated circuit die, the first side closer to the fluidics structure than the second side.

14. The method of claim 12, wherein supplying coolant to the integrated circuit die comprises supplying ink to the integrated circuit die.

15. The method of claim 14, wherein supplying coolant to the integrated circuit die comprises supplying ink, which has passed through a bypass ink channel within the substrate that bypasses the fluidics structure, to the integrated circuit die.

* * * * *